US009078301B2

(12) United States Patent
Li et al.

(10) Patent No.: US 9,078,301 B2
(45) Date of Patent: Jul. 7, 2015

(54) OUTPUT STAGE CIRCUIT FOR GATE DRIVING CIRCUIT IN LCD

(75) Inventors: Po-Ching Li, Hsinchu (TW); Chao-Chih Hsiao, Taipei (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 527 days.

(21) Appl. No.: 13/414,699

(22) Filed: Mar. 7, 2012

(65) Prior Publication Data

US 2013/0234626 A1 Sep. 12, 2013

(51) Int. Cl.
*H05B 37/02* (2006.01)
*G09G 3/36* (2006.01)

(52) U.S. Cl.
CPC ..... *H05B 37/02* (2013.01); *G09G 3/3677* (2013.01); *G09G 2320/0219* (2013.01)

(58) Field of Classification Search
USPC ..... 315/360, 323, 291, 307, 311, 315/169.1–169.3, 209 R, 210, 224, 225, 315/308, 312; 326/93–98; 345/94, 99, 100, 345/204, 208–210
See application file for complete search history.

(56) References Cited

U.S. PATENT DOCUMENTS

| | | | | |
|---|---|---|---|---|
| 6,329,836 | B1 * | 12/2001 | Drost et al. | 326/30 |
| 7,038,486 | B2 * | 5/2006 | Aoyama et al. | 326/30 |
| 7,248,088 | B2 * | 7/2007 | Hargan | 327/170 |
| 7,995,005 | B2 * | 8/2011 | Kim et al. | 345/60 |
| 2009/0256493 | A1 * | 10/2009 | Tonomura | 315/291 |

* cited by examiner

*Primary Examiner* — Jimmy Vu
(74) *Attorney, Agent, or Firm* — Winston Hsu; Scott Margo

(57) ABSTRACT

Output stage circuit is added to the gate driving circuit of the LCD. The output stage circuit moderates the falling slope of the gate driving signal so as to reduce the feed-through phenomenon. The output stage circuit includes a discharge circuit which discharges the voltage of the gate driving signal with programmable speeds. The discharge circuit has a plurality of discharge units which are turned on sequentially and designed with different driving abilities. At beginning of falling of the gate driving signal, the discharge circuit discharges the gate driving signal with lower driving ability so that the gate driving signal falls with a lower speed. As time passes, the falling speed of the gate driving signal increases by the increasing of the driving ability of the discharge circuit. The entire falling period of the gate driving signal is prolonged by the output stage circuit and the feed-through phenomenon is eased.

10 Claims, 15 Drawing Sheets

OUTPUT STAGE CIRCUIT FOR GATE DRIVING CIRCUIT IN LCD

BACKGROUND OF THE INVENTION

1. Field of the Invention

The present invention relates to an output stage circuit for gate driving circuit in an LCD, and more particularly, to an output stage circuit for gate driving circuit in an LCD for reducing the feed-through effect phenomenon.

2. Description of the Prior Art

In liquid crystal displays (LCDs), if a gate driving signal outputted from the gate driving circuit falls too fast, which means its falling edge is too sharp, the Gamma data stored therein become incorrect, because the effect of feed-through phenomenon thought parasitic capacitance. More specifically, if the voltage of the gate driving signal drops too fast, the signal will be coupling to the thin film transistors of the pixels corresponding to the gate line through the intrinsic capacitors of the thin film transistors, causing the final voltage on the liquid crystal particle differs from the voltage the source driving circuit writes. Such phenomenon is called feed-through phenomenon.

FIG. 1 shows a conventional modulation mechanism to solve the feed-through phenomenon. In the LCD 100, a power circuit 120 provides a fixed voltage VO, a timing controller 140 controls a gate driving circuit 130 and a source driving circuit 150. To solve the feed-through phenomenon, a modulation circuit 110 is added in the LCD 100 to modulate the waveform of the output voltage VO from the power circuit 120 to be modulated VM. Then the modulated voltage VM is provided to the gate driving circuit 130 as its supply voltage. The modulation circuit 110 is also controlled by the timing controller 140. More particularly, when the timing controller 140 controls the gate driving circuit 130 to lower the gate driving signal SG, the modulation circuit 110 is also controlled to modulate the output voltage VO lowered as shown in FIG. 1 (to become the modulated voltage VM). Consequently, the final voltage supplied to the gate driving circuit 130 drops when the gate driving circuit 130 lowers the gate driving signal SG. In this way, the ability of the gate driving circuit 130 is decreased, and thus the slope of the gate driving signal SG becomes more moderate.

FIG. 2 shows the waveform of the gate driving signal SG before/after the output voltage VO is modulated. FIG. 2A shows the output voltage VO is not modulated, causing the gate driving signal SG falls sharply. FIG. 2B shows the output voltage VO is modulated to be the modulated voltage VM and then is supplied to the gate driving circuit 130. In FIG. 2B, the gate driving signal SG falls moderately by the drop of the supplied voltage (VM).

However, to solve the feed-through phenomenon, an LCD has to be added with the modulation circuit, causing wasting on total power consumption and cost of the LCD, which is inconvenient for users.

SUMMARY OF THE INVENTION

The present invention provides an output stage circuit for a gate driving circuit in a liquid crystal display (LCD). The output stage circuit comprises a charge unit, coupled to a gate line of the gate driving circuit for charging the gate line with a first supply voltage; a first discharge unit, coupled to the gate line of the gate driving circuit for discharging the gate line to a second supply voltage; a second discharge unit, coupled to the gate line of the gate driving circuit for discharging the gate line to the second supply voltage; and a control circuit for controlling the charge unit, the first and the second discharge units according to a timing controller of the LCD; wherein the control circuit sequentially turns on the first and the second discharge units.

The present invention further provides an output stage circuit for a gate driving circuit in a liquid crystal display (LCD). The output stage circuit comprises a discharge unit, coupled to a gate line of the gate driving circuit for discharging the gate line to a first supply voltage; a first charge unit, coupled to the gate line of the gate driving circuit for charging the gate line with a second supply voltage; a second charge unit, coupled to the gate line of the gate driving circuit for charging the gate line with the second supply voltage; and a control circuit for controlling the first and the second charge units, and the discharge circuit according to a timing controller of the LCD; wherein the control circuit sequentially turns on the first and the second charge units.

The present invention further provides an output stage circuit for a gate driving circuit in a liquid crystal display (LCD). The output stage circuit comprises a charge unit, coupled to a gate line of the gate driving circuit for charging the gate line with a first supply voltage; a discharge unit, coupled to the gate line of the gate driving circuit for discharging the gate line to a second supply voltage; and a control circuit for controlling the charge and the discharge units according to a timing controller of the LCD; wherein the control circuit turns on the discharge unit with a first degree for a first predetermined period and then with a second degree for a second predetermined period when the timing controller controls the gate driving circuit to decrease a voltage on the gate line; wherein driving ability of the discharge unit turned on with the first degree is lower than driving ability of the discharge unit turned on with the second degree.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
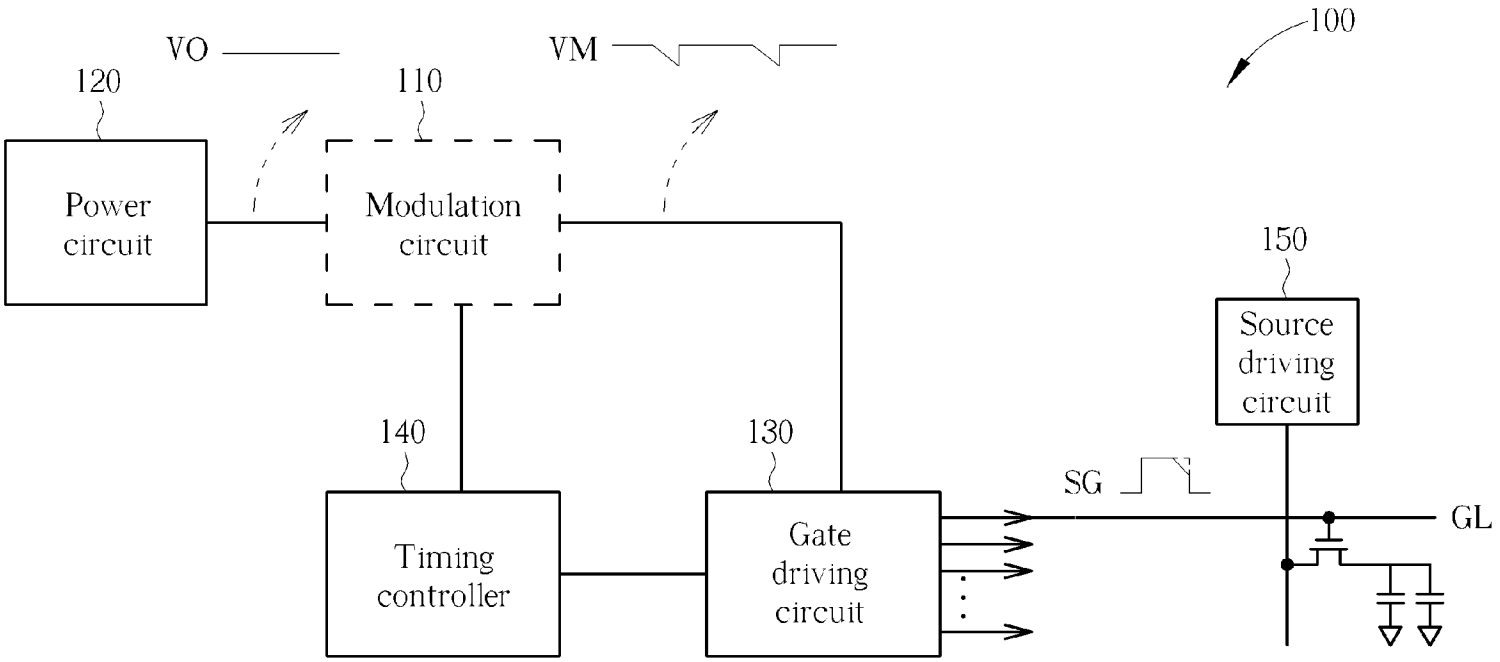
FIG. 1 PRIOR ART
FIG. 1 shows a conventional modulation mechanism to solve the feed-through phenomenon.
Figure 2:
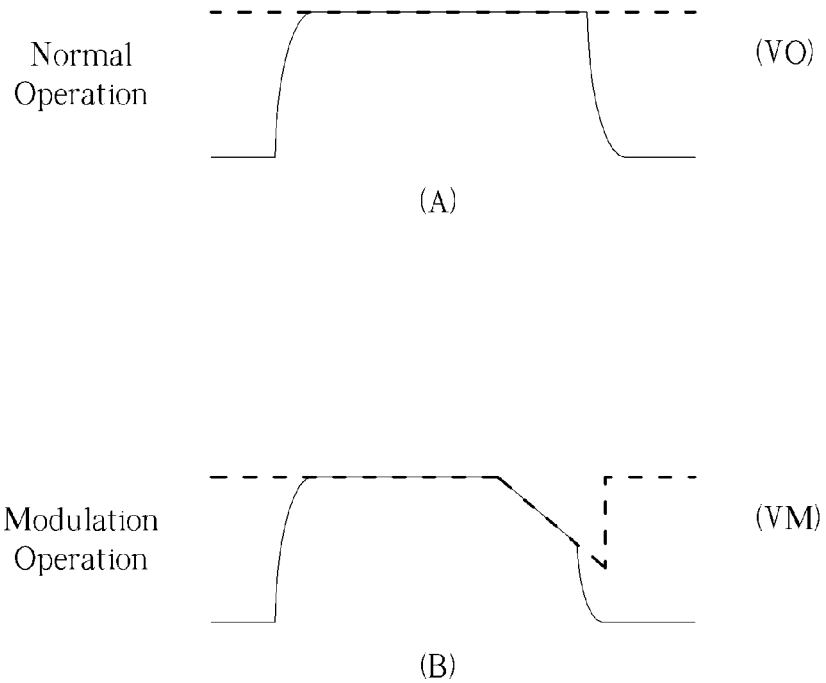
FIG. 2 PRIOR ART
FIG. 2 shows the waveform of the gate driving signal before/after the output voltage is modulated.
Figure 3A:
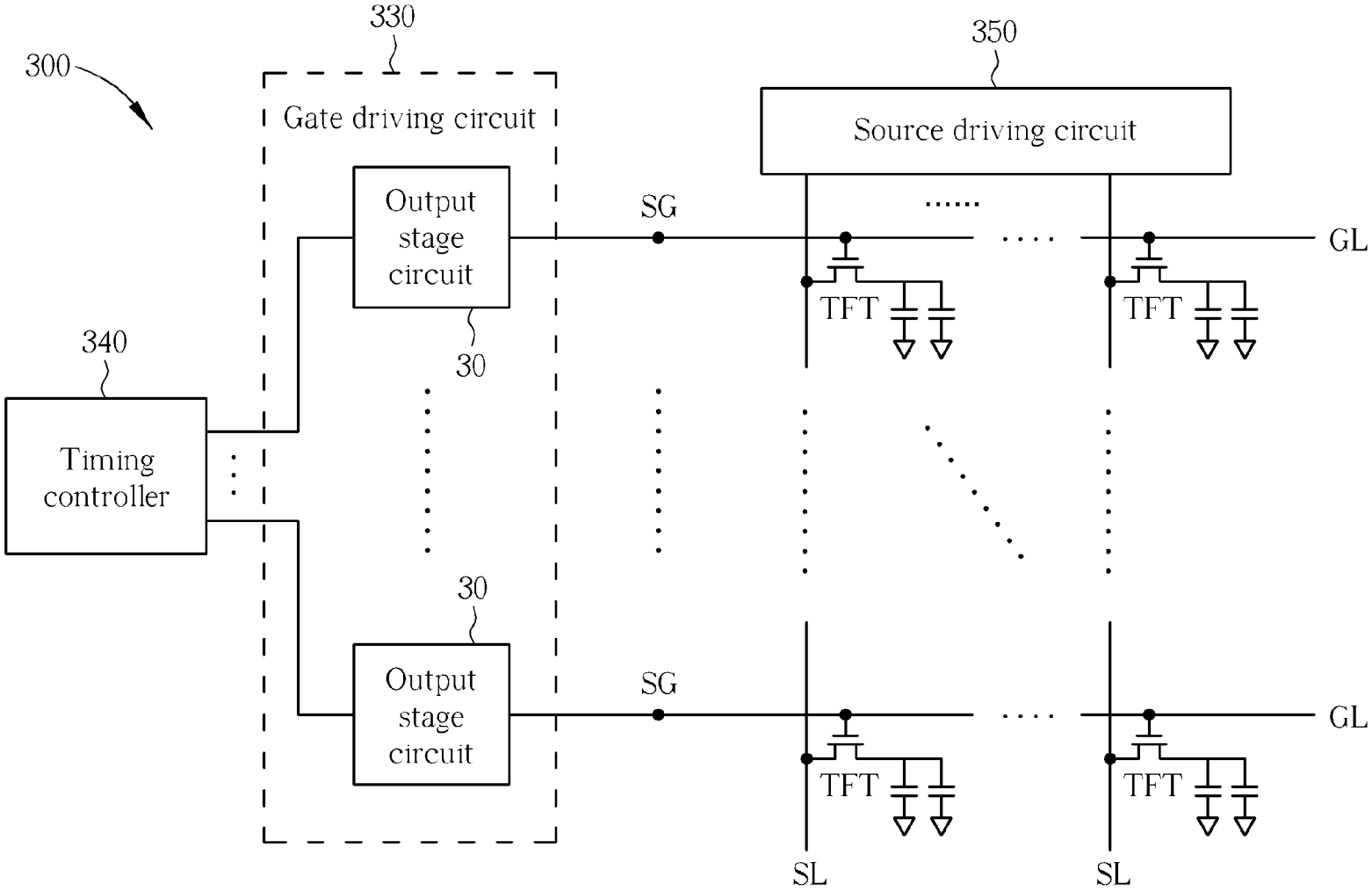
FIG. 3A shows an LCD according to an embodiment of the present invention.

FIG. 3A shows an LCD 300 according to an embodiment of the present invention. The LCD 300 comprises a panel, a gate driving circuit 330, a timing controller 340 and a source driving circuit 350. The panel comprises a plurality of gate lines GL, a plurality of source lines SL, and transistors TFT. The gate driving circuit 330 comprises a plurality of output stage circuit 30 each corresponding to a gate line GL. Please refer to FIG. 3B, which illustrates a schematic diagram of one of the output stage circuits 30 shown in FIG. 3A according to a first embodiment of the present invention. The output stage circuit 30 is utilized for modulating gate driving signals, and is coupled to one gate line GL in the gate driving circuit 330. The output stage circuit 30 comprises a control circuit 31, a charge circuit 32, and a discharge circuit 33. In this embodiment, the charge circuit 32 comprises a single charge unit 321, and the discharge circuit 33 comprises a plurality of discharge units 331-33*n*. Besides, the supply voltage VS1 is higher than the supply voltage VS2.

The timing controller 340 controls the gate driving circuit 330, the source driving circuit 350, and the control circuit 31 of the output stage circuit 30. The control circuit 31 controls the charge circuit 32 to charge to the gate line GL, and controls the discharge circuit 33 to discharge to the gate line GL. More specifically, the control circuit 31 controls the charge unit 321 of the charge circuit 32 by a control signal VA, and controls the discharge units 331-33*n* of the discharge circuit 33 by n control signals VB1~VBn.

When the timing controller 340 controls the gate driving circuit 330 to charge the gate line GL, the control circuit 31 controls the charge unit 321 of the charge circuit 32 to charge the gate line GL as well. When the timing controller 340 controls the gate driving circuit 330 to discharge the gate line GL, the control circuit 31 controls the discharge units 331-33*n* of the charge circuit 33 to discharge the gate line GL respectively. The control circuit 31 adjusts the driving ability of the discharge circuit 33 by selectively turning on a predetermined number of the discharge units 331-33*n*. For example, the driving ability is maximized when all discharge units 331-33*n* are turned by the control circuit 31 to discharge the gate line GL, and the driving ability is minimized when all discharge units 331-33*n* are turned off by the control circuit 31. By adjusting the driving ability of the discharge circuit 33, the falling slope of the voltage drop on the gate line GL (the gate driving signal SG) becomes moderately.

Figure 3B:
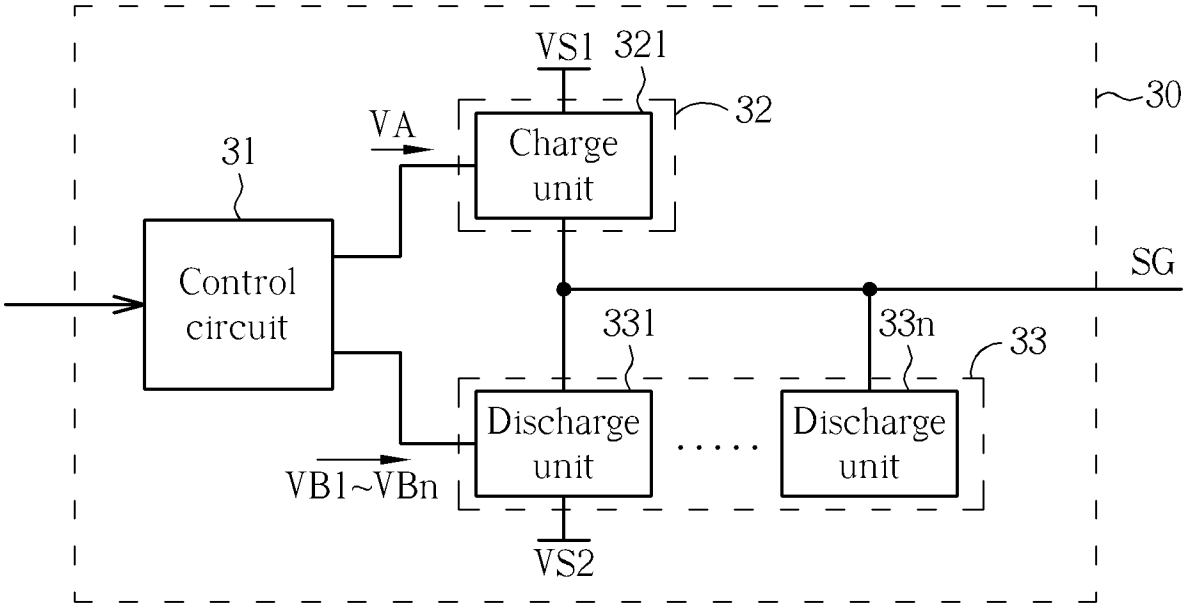
FIG. 3B shows an output stage circuit for modulating gate driving signals according to a first embodiment of the present invention.
Figure 4:
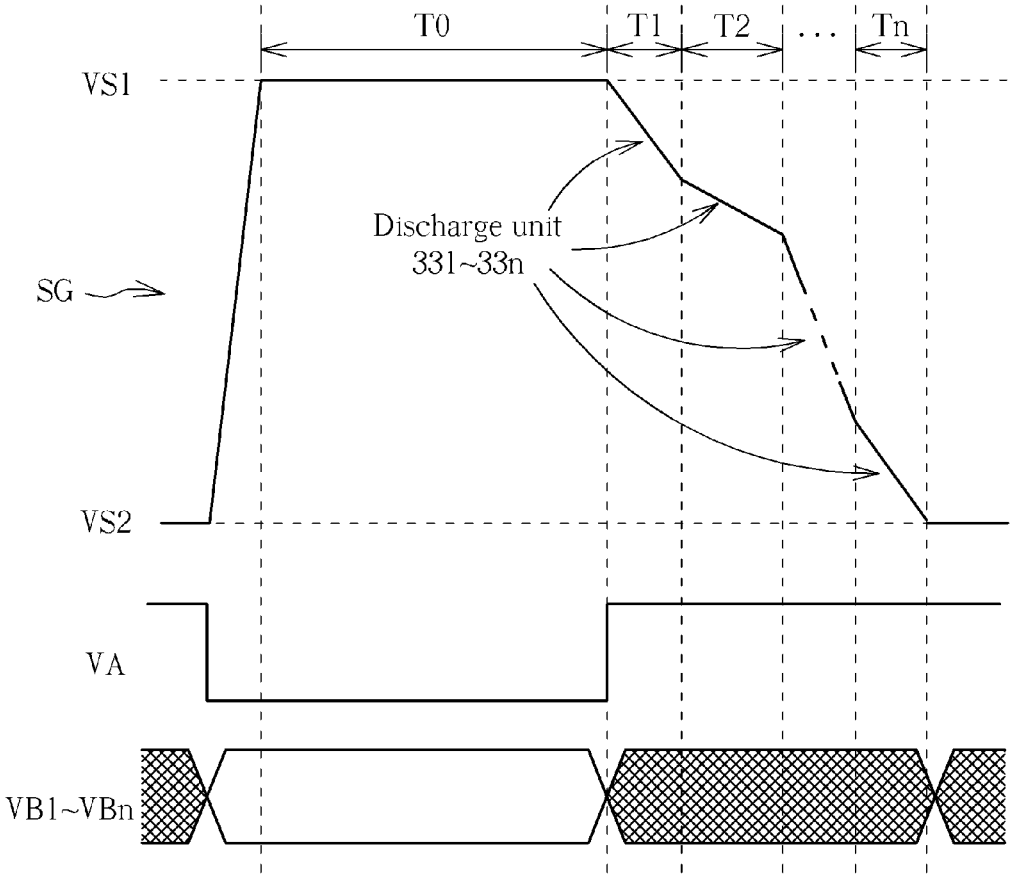
FIG. 4 shows operation principle of the output stage circuit of FIG. 3B.

FIG. 4 shows operation principle of the output stage circuit 30 of FIG. 3B. When the timing controller 340 controls the gate driving circuit 330 to charge the gate line GL, the control circuit 31 controls the charge unit 321 of the charge circuit 32 to charge the gate line GL by the control signal VA with the supply voltage VS1. Consequently, the voltage of the gate driving signal SG increases as shown in FIG. 4. Since only one charge unit is disposed in the charge circuit 32, the rising slope of the voltage of the gate driving signal SG keeps the same.

When the timing controller 340 controls the gate driving circuit 330 to discharge the gate line GL, the control circuit 31 controls the discharge units 331-33*n* of the charge circuit 33 to discharge the gate line GL sequentially. As shown in FIG. 4, during the period T1, the control signals VB1 controls the discharge unit 331 to discharge the gate line GL; during the period T2, the control signals VB2 controls the discharge unit 332 to discharge the gate line GL; . . . ; during the period Tn, the control signals VBn controls the discharge unit 33*n* to discharge the gate line GL. The driving abilities of each discharge units 331-33*n* are designed preferably to be different. Optionally, the driving ability of the discharge unit 33*n* is higher than that of the discharge unit 33($n$−1), the driving ability of the discharge unit 33($n$−1) is higher than that of the discharge unit 33($n$−2); . . . ; the driving ability of the discharge unit 332 is higher than the of the discharge unit 331. In this way, the voltage of the gate driving signal SG does not drop too fast at beginning, and gets faster and faster. Consequently, the falling slope of the gate driving signal SG will not be too sharp, so as to avoid the feed-through phenomenon.

Figure 5:
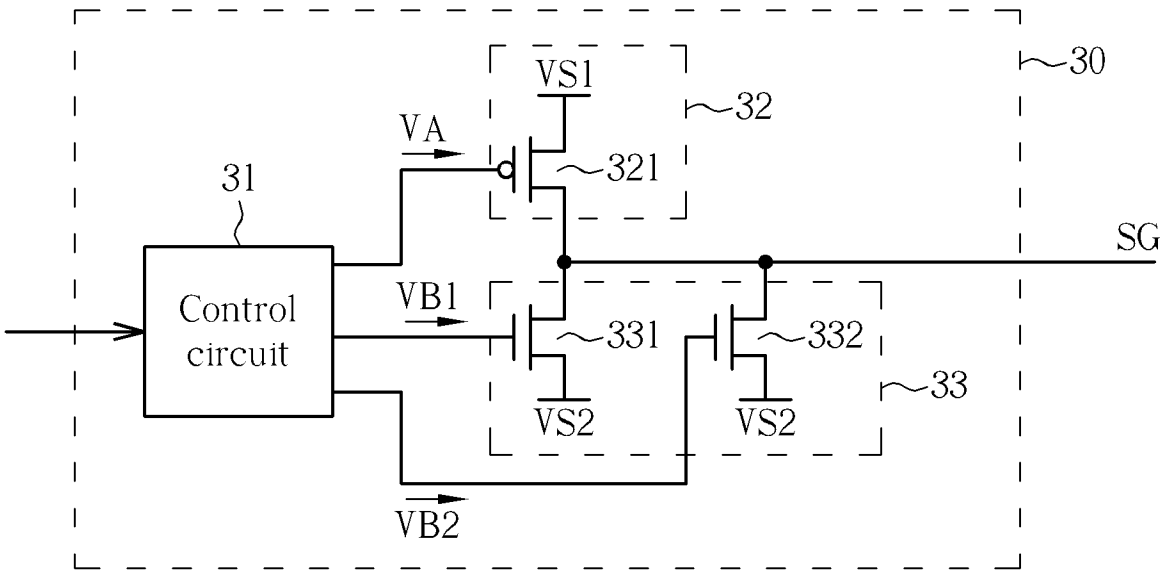
FIG. 5 shows an example of the output stage circuit of the first embodiment of the present invention.

FIG. 5 shows an example of the output stage circuit 30 of the first embodiment of the present invention, with the number n being set to 2. The charge unit 321 can be realized with a P-type metal oxide semiconductor (PMOS) transistor, coupled to the gate line GL for charging the gate line GL with the supply voltage VS1. The discharge circuit 33 comprises two discharge units 331 and 332. The discharge unit 331 can be realized with an NMOS transistor, coupled to the gate line GL for discharging the gate line GL to the supply voltage VS2. The discharge unit 332 can be realized with an NMOS transistor, coupled to the gate line GL for discharging the gate line GL to the supply voltage VS2.

Figure 6:
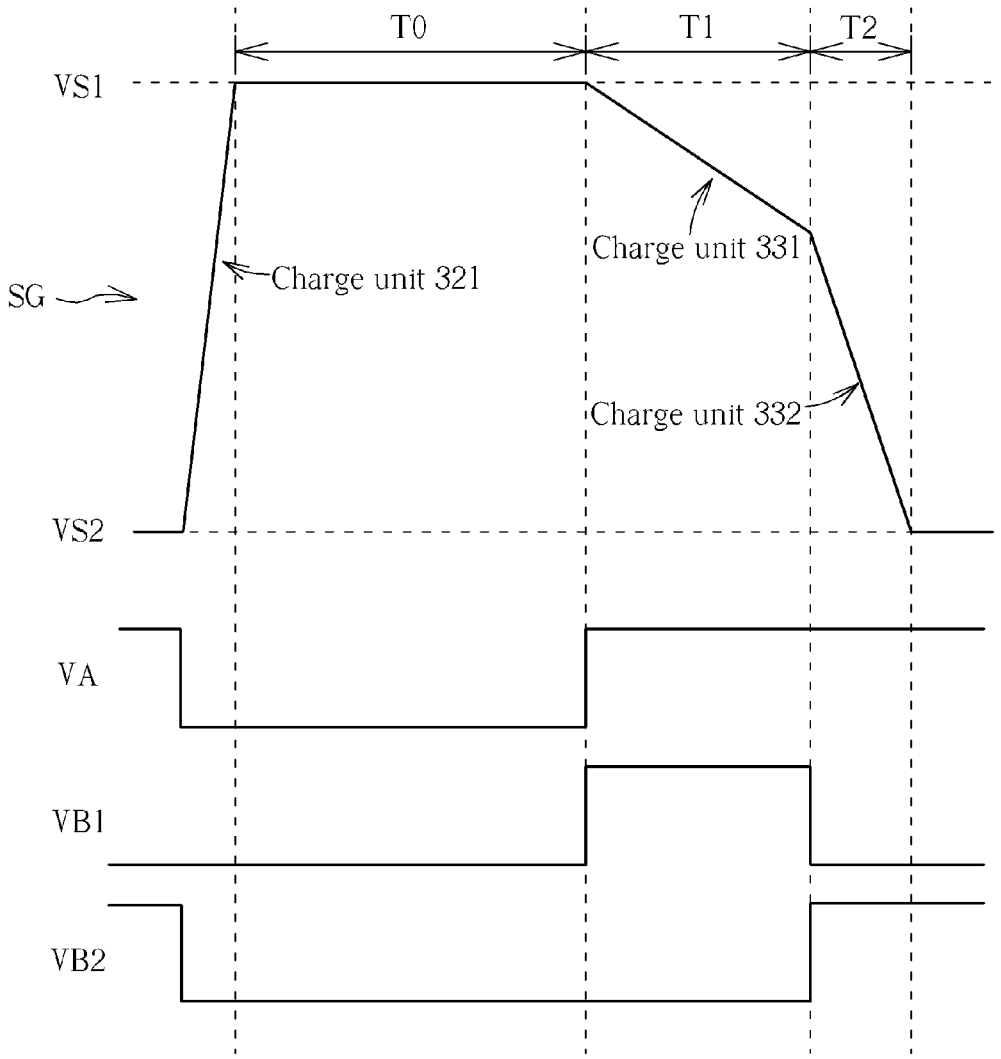
FIG. 6 shows operational principle of the exemplary output stage circuit of FIG. 5.

FIG. 6 shows operational principle of the exemplary output stage circuit of FIG. 5. Especially, the driving ability of the discharge unit 332 is designed to be higher than that of the discharge unit 331. When the timing controller 340 controls the gate driving circuit 330 to charge the gate line GL (the gate driving signal SG rises), the control circuit 31 controls the charge unit 321 of the charge circuit 32 to charge the gate line GL. As shown in FIG. 6, the control signal VA drops, the charge unit 321 is fully turned on to charge the gate line GL with the supply voltage VS1. Since only one charge unit is disposed in the charge circuit 32 and is fully turned on, the rising slope of the gate driving signal SG keeps the same.

When the timing controller 340 controls the gate driving circuit 330 to discharge the gate line GL (the gate driving signal SG falls), the control circuit 31 controls the discharge units 331 and 332 of the charge circuit 33 to discharge the gate line GL sequentially. As shown in FIG. 6, during the period T1, the control signal VB1 fully turns on the discharge unit 331 for discharging the gate line GL to the supply voltage VS2 and the control signal VB2 turns off the discharge unit 332; during the period T2, the control signal VB1 turns off the discharge unit 331 and the control signal VB2 fully turns on the discharge unit 332 for discharging the gate line GL to the supply voltage VS2.

In this way, since the driving ability of the discharge unit 331 is lower than that of the discharge unit 332, the gate driving signal SG during the period T1 drops slower than during the period T2. Overall, the falling slope of the gate driving signal SG becomes moderate, which eases the feed-through phenomenon.

Figure 7:
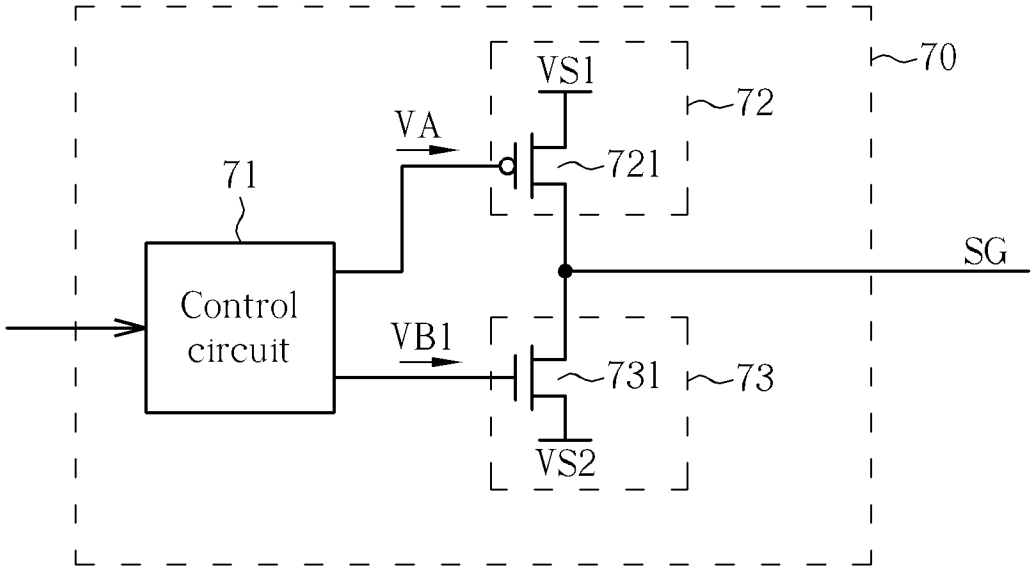
FIG. 7 shows an output stage circuit for modulating gate driving signals according to a second embodiment of the present invention.

FIG. 7 shows an output stage circuit 70 for modulating gate driving signals according to a second embodiment of the present invention. The output stage circuit 70 can be substitute for the output stage circuits 30 shown in FIG. 3A, and thus, is also coupled to a gate line GL in the gate driving circuit 330. The output stage circuit 70 comprises a control circuit 71, a charge circuit 72, and a discharge circuit 73. In this embodiment, the charge circuit 72 comprises a single charge unit 721, and the discharge circuit 33 comprises a single discharge unit 731.

Figure 8:
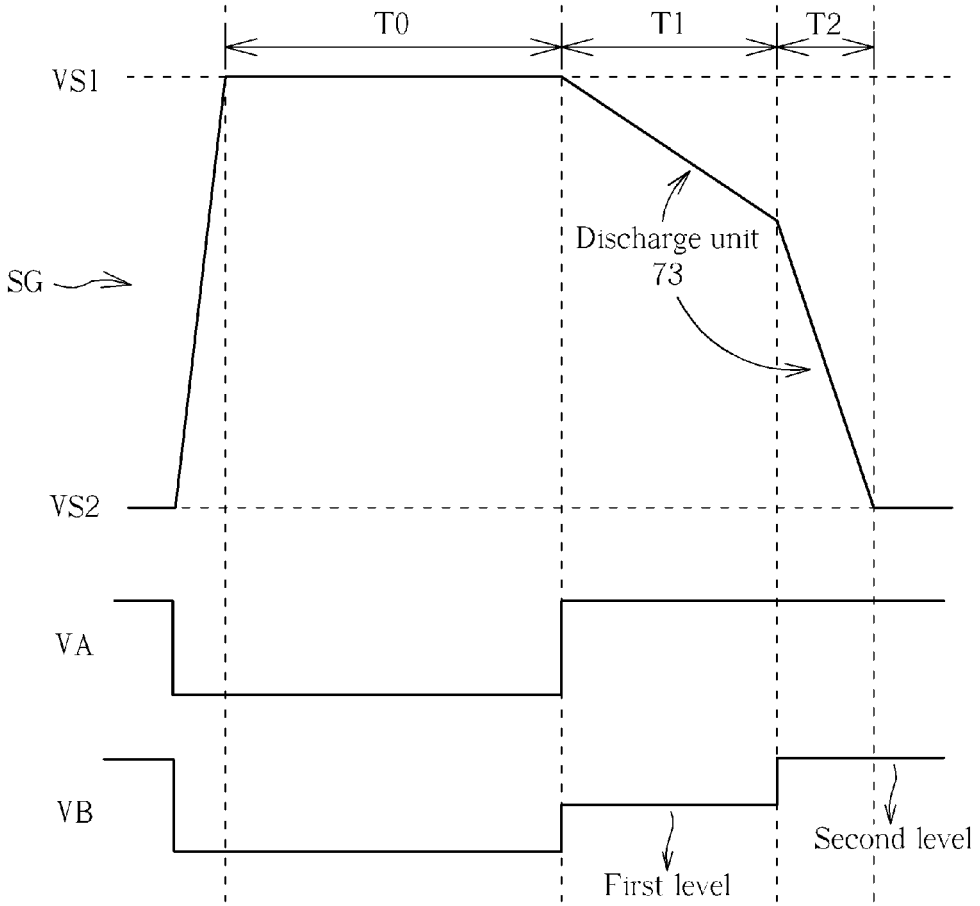
FIG. 8 shows operation principle of the output stage circuit of FIG. 7.

FIG. 8 shows operation principle of the output stage circuit 70 of FIG. 7. The operational principle of the charge circuit 72 is same as the charge circuit 32 and is omitted for brevity. The control circuit 71 adjusts the driving ability of the discharge unit 731 by adjusting the voltage of the control signal VB1. When the timing controller 340 controls the gate driving circuit 330 to discharge the gate line GL, first, during the period T1, the control circuit 71 controls the voltage of the control signal VB to a first level so that the discharge unit 731 discharges the gate line GL with a first speed (which means the discharge unit 731 is not fully turned), and second, during the period T2, the control circuit 71 controls the voltage of the control signal VB to a second level so that the discharge unit 731 discharges the gate line with a second speed (which means the discharge unit is fully turned), wherein the first speed is slower than the second speed. As shown in FIG. 8, the falling slope of the gate driving signal SG becomes moderate by adjusting the voltage of the control signal VB for the discharge circuit 73. In this way, the voltage of the gate driving signal SG does not drop too fast at beginning, and gets faster later. Consequently, the falling slope of the gate driving signal SG will not be too sharp, so as to avoid the feed-through phenomenon as well.

Figure 9:
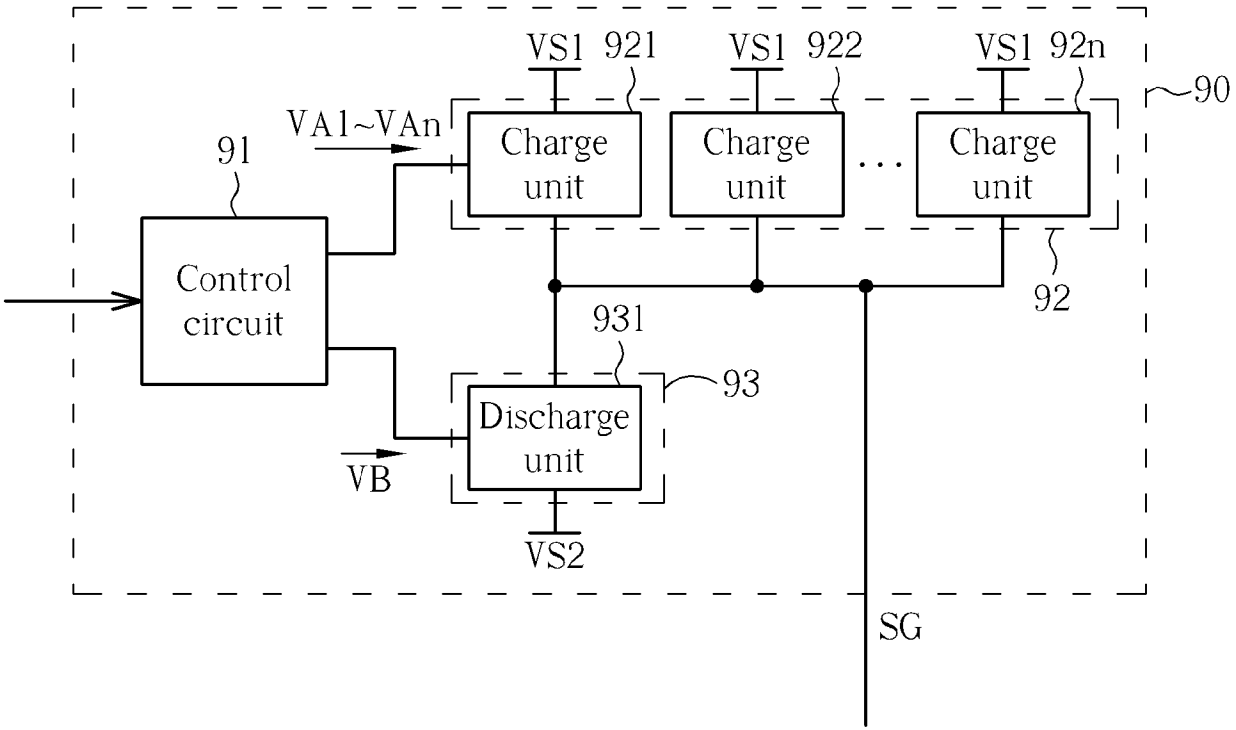
FIG. 9 shows an output stage circuit for modulating gate driving signals according to a third embodiment of the present invention.

FIG. 9 shows an output stage circuit 90 for modulating gate driving signals according to a third embodiment of the present invention. The output stage circuit 90 can be substitute for the output stage circuits 30 shown in FIG. 3A, and thus, is also coupled to a gate line GL in the gate driving circuit 330. The output stage circuit 90 comprises a control circuit 91, a charge circuit 92, and a discharge circuit 93. In this embodiment, the charge circuit 92 comprises a plurality of charge units 921-92*n*, and the discharge circuit 93 comprises a single discharge unit 931.

The driving abilities of each charge units 921-92*n* are designed preferably to be different. Optionally, the driving ability of the charge unit 92*n* is lower than that of the charge unit 92($n$−1), the driving ability of the charge unit 92($n$−1) is lower than that of the charge unit 92($n$−2); . . . ; the driving ability of the charge unit 922 is lower than the of the charge unit 921.

Figure 10:
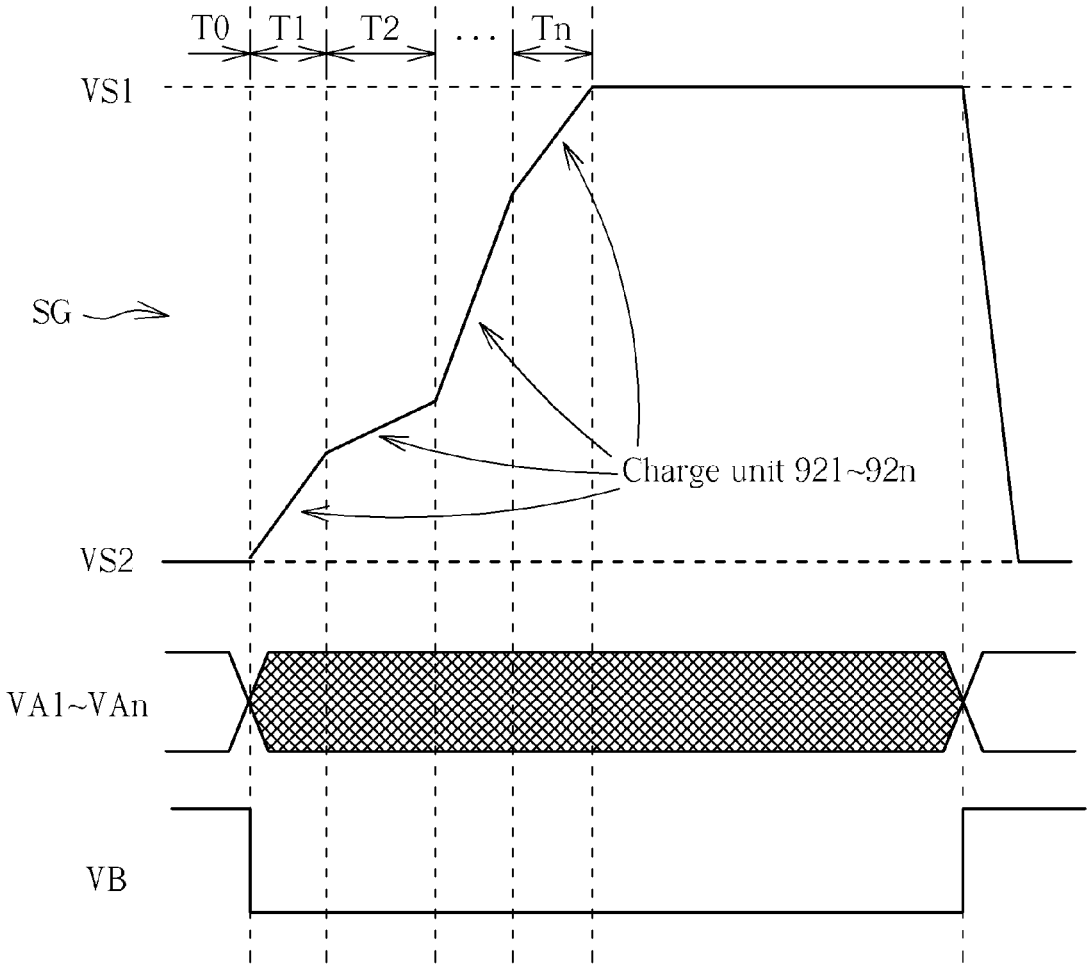
FIG. 10 shows operation principle of the output stage circuit of FIG. 9.

FIG. 10 shows operation principle of the output stage circuit 90 of FIG. 9. The output stage circuit 90 operates similarly to the output stage circuit 30, and can be easily inferred for the person skilled in the art after reading the description for FIG. 3B and FIG. 4. Therefore, description for FIG. 9 and FIG. 10 is omitted for brevity.

Figure 11:
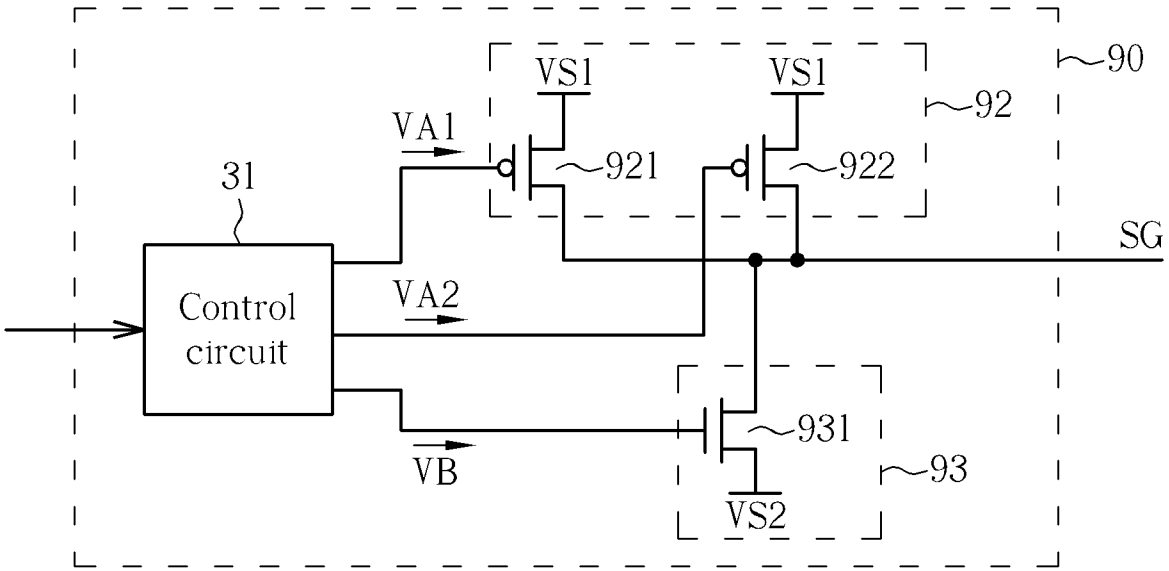
FIG. 11 shows an example of the output stage circuit of the third embodiment of the present invention.
Figure 12:
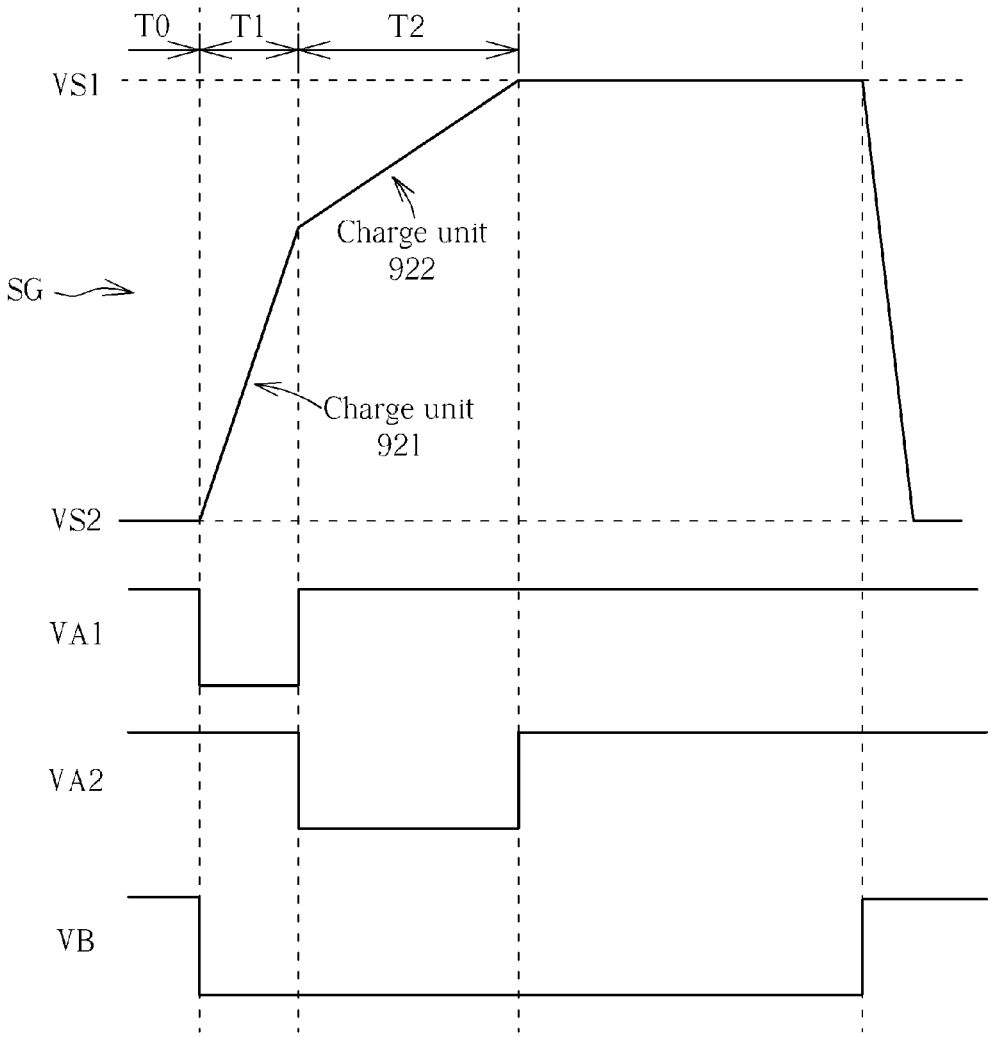
FIG. 12 shows operational principle of the exemplary output stage circuit of FIG. 11.

FIG. 11 shows an example of the output stage circuit 90 of the third embodiment of the present invention, with the number n being set to 2. FIG. 12 shows operational principle of the exemplary output stage circuit of FIG. 11. The output stage circuit 90 in FIG. 11 operates similarly to the output stage circuit 30, and can be easily inferred for the person skilled in the art after reading the description for FIG. 5 and FIG. 6. Therefore, description for FIG. 11 and FIG. 12 is omitted for brevity.

Figure 13:
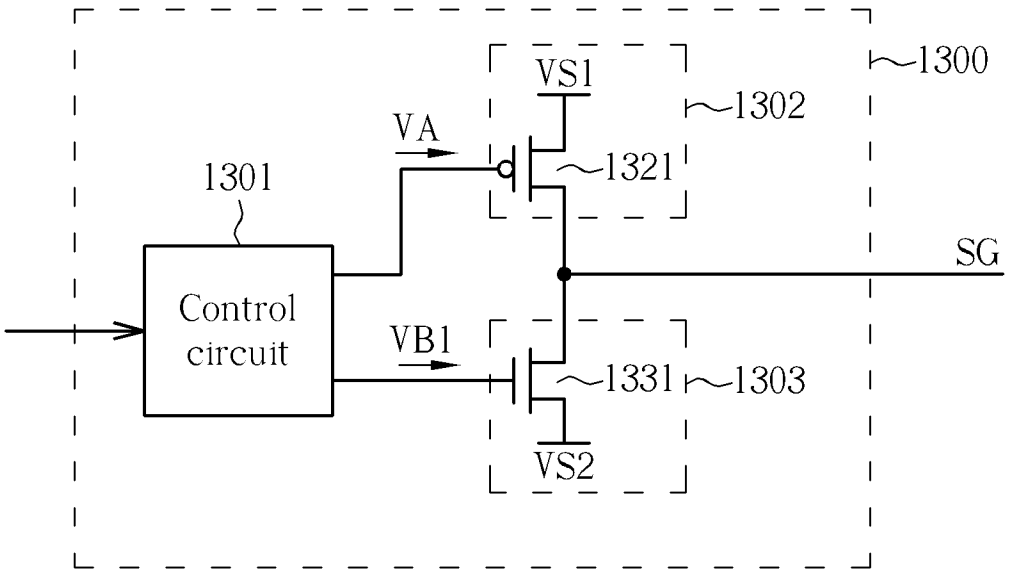
FIG. 13 shows an output stage circuit for modulating gate driving signals according to a fourth embodiment of the present invention.
Figure 14:
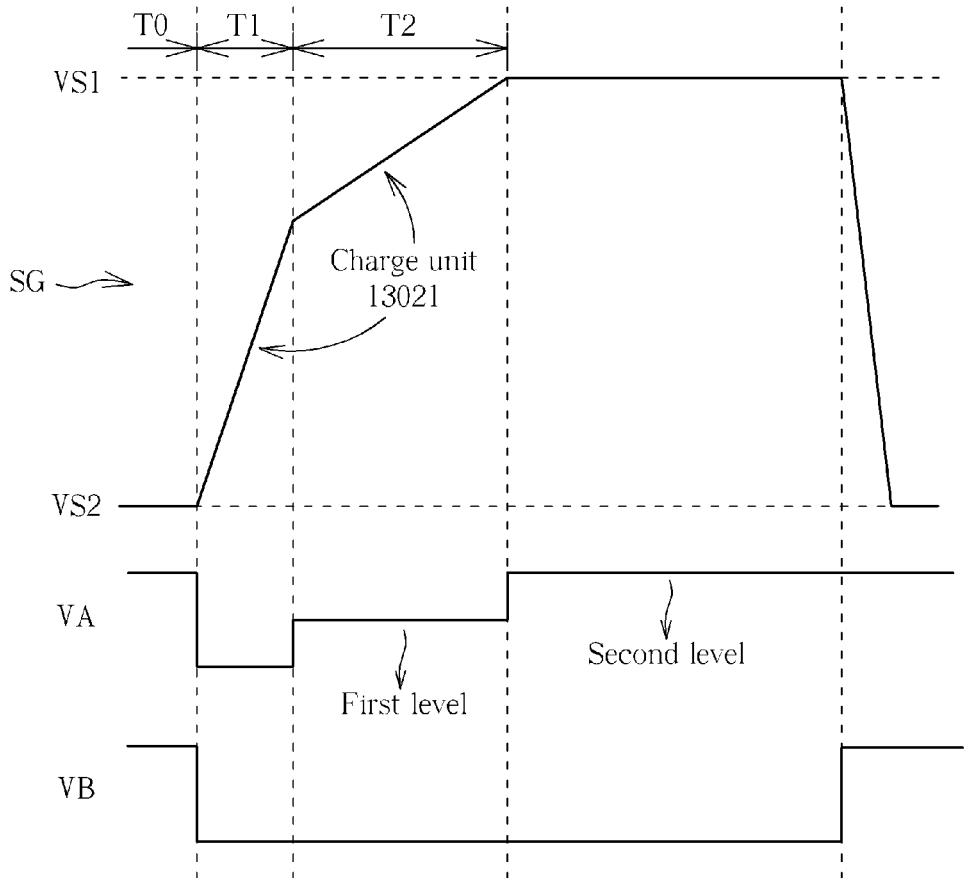
FIG. 14 shows operation principle of the output stage circuit of FIG. 13.

FIG. 13 shows an output stage circuit 1300 for modulating gate driving signals according to a fourth embodiment of the present invention. FIG. 14 shows operation principle of the output stage circuit 1300 of FIG. 13. The output stage circuit 1300 can be substitute for the output stage circuits 30 shown in FIG. 3A, operates similarly to the output stage circuit 70, and can be easily inferred for the person skilled in the art after reading the description for FIG. 7 and FIG. 8. Therefore, description for FIG. 13 and FIG. 14 is omitted for brevity.

Furthermore, the output stage circuit of the present invention can be realized in the gate driving circuit. In other words, the output stage circuit of the present invention and the gate driving circuit can be manufactured in the same chip for reducing the cost and saving the power. The amount of the output stage circuits disposed in the LCD can be decided by the number of the gate lines of the LCD, which means if the resolution of the LCD is higher, the amount of the output stage circuits become more.

Additionally, the first embodiment of the output stage circuit of the present invention and the third embodiment of the output stage circuit of the present invention can be combined to form another embodiment wherein both of the charge and the discharge circuits have a plurality of charge/discharge units. In this way, the waveform of the gate driving signal will be more flexible.

Although in the description for the output stage circuit of the present invention, the control circuit is controlled by the timing controller, the control circuit can also be controlled by the gate driving circuit. In other words, the output signals from the gate driving circuit can be as the input for the control circuit. The control circuit then controls the charge/discharge circuit according to the signals received from the gate driving circuit instead.

To sum up, the output stage circuit of the present invention reduces the LCD feed-through phenomenon by programming the falling slope of the gate driving signals. The falling slope of the gate driving signals can be adjusted by turning on different numbers of the discharge circuits of the output stage circuit or turning on the discharge circuit of the output stage circuit with different degrees. Besides, the output stage circuit of the present invention also adjusts the rising slope of the gate driving signals, providing much more flexibility for users.

Those skilled in the art will readily observe that numerous modifications and alterations of the device and method may be made while retaining the teachings of the invention.

What is claimed is:

1. An output stage circuit for a gate driving circuit in a liquid crystal display (LCD), the output stage circuit comprising:

a charge unit, coupled to a gate line of the gate driving circuit for charging the gate line with a first supply voltage;

a first discharge unit, coupled to the gate line of the gate driving circuit for discharging the gate line from the first supply voltage to a specific voltage between the first supply voltage and a second supply voltage;

a second discharge unit, coupled to the gate line of the gate driving circuit for discharging the gate line from the specific voltage to the second supply voltage; and a control circuit for controlling the charge unit, the first and the second discharge units according to a timing controller of the LCD.

2. The output stage circuit of claim 1, wherein the first supply voltage is higher than the second supply voltage.

3. The output stage circuit of claim 1, wherein when the timing controller controls the gate driving circuit to charge a voltage on the gate line, the control circuit turns on the charge unit for charging the gate line with the first supply voltage.

4. The output stage circuit of claim 1, wherein driving ability of the first discharge unit is different from driving ability of the second discharge unit.

5. The output stage circuit of claim 1, wherein when the timing controller controls the gate driving circuit to discharge a voltage on the gate line, the control circuit turns on the first discharge unit for a first predetermined period and turns off the second discharge unit within the first predetermined period, and then turns on the second discharge unit for a second predetermined period and turns off the first discharge unit within the second predetermined period.

6. The output stage circuit of claim 1, wherein the control circuit sequentially turns on the first and the second discharge units.

7. An output stage circuit for a gate driving circuit in a liquid crystal display (LCD), the output stage circuit comprising:

a charge unit, coupled to a gate line of the gate driving circuit for charging the gate line with a first supply voltage;

a discharge unit, coupled to the gate line of the gate driving circuit for discharging the gate line to a second supply voltage; and a control circuit for controlling the charge and the discharge units according to a timing controller of the LCD;

wherein the control circuit turns on the discharge unit with a first degree for a first predetermined period to discharge the gate line from the first supply voltage to a specific voltage between the first supply voltage and the second supply voltage and with a second degree for a second predetermined period to discharge the gate line from the specific voltage to the second supply voltage when the timing controller controls the gate driving circuit to decrease a voltage on the gate line.

8. The output stage circuit of claim 7, wherein the first supply voltage is higher than the second supply voltage.

9. The output stage circuit of claim 7, wherein when the timing controller controls the gate driving circuit to charge the voltage on the gate line, the control circuit turns on the charge unit for charging the gate line with the first supply voltage.

10. The output stage circuit of claim 7, wherein driving ability of the discharge unit turned on with the first degree is lower than driving ability of the discharge unit turned on with the second degree.

* * * * *